US011564465B1

(12) United States Patent
Hale

(10) Patent No.: US 11,564,465 B1
(45) Date of Patent: Jan. 31, 2023

(54) CANE WITH A LEG STRAP

(71) Applicant: Michael Hale, Corbin, KY (US)

(72) Inventor: Michael Hale, Corbin, KY (US)

( * ) Notice: Subject to any disclaimer, the term of this patent is extended or adjusted under 35 U.S.C. 154(b) by 0 days.

(21) Appl. No.: 17/376,746

(22) Filed: Jul. 15, 2021

(51) Int. Cl.

| | |
|---|---|
| ***A45B 9/00*** | (2006.01) |
| ***A45B 3/04*** | (2006.01) |
| ***A45B 3/02*** | (2006.01) |
| ***A45B 9/02*** | (2006.01) |
| ***A45B 9/04*** | (2006.01) |

(52) U.S. Cl.
CPC ..... *A45B 3/04* (2013.01); *A45B 3/02* (2013.01); *A45B 9/02* (2013.01); *A45B 9/04* (2013.01); *A45B 2009/002* (2013.01)

(58) Field of Classification Search
CPC ..... A45B 2009/002; A61H 2003/007
See application file for complete search history.

(56) References Cited

U.S. PATENT DOCUMENTS

| | | | | | |
|---|---|---|---|---|---|
| 1,185,906 | A * | 6/1916 | Hoff | A61F 2/60 | 623/28 |
| 4,884,587 | A * | 12/1989 | Mungons | A61H 3/00 | 135/65 |
| 6,206,018 | B1 * | 3/2001 | Daniels, Jr. | A61H 3/02 | 135/69 |
| 7,087,030 | B2 * | 8/2006 | Wang | A61F 5/04 | 602/5 |
| 9,180,037 | B1 * | 11/2015 | Smith | A61F 5/0111 | |
| 9,226,555 | B1 * | 1/2016 | Shyu | A45B 9/02 | |
| 10,034,522 | B1 | 7/2018 | Anglade | | |
| 2003/0213510 | A1 * | 11/2003 | MacCready | A61H 3/00 | 135/65 |
| 2017/0105862 | A1 * | 4/2017 | Griggs | A61F 5/0106 | |
| 2019/0105219 | A1 * | 4/2019 | Pierro | A61F 5/3761 | |

* cited by examiner

*Primary Examiner* — Noah Chandler Hawk

(74) *Attorney, Agent, or Firm* — Sanchelima & Associates, P.A.; Christian Sanchelima; Jesus Sanchelima

(57) ABSTRACT

A cane includes an integral light in the handle, a leg attachment strap, and a foot attaching stirrup. The cane includes a rod assembly and a stirrup assembly. In one embodiment, the rod assembly includes a rod being a uniform cylindrical structure that is adapted to extend the length of a user's leg. The handle is disposed at a top most end of the rod and includes the light being embedded therein to provide illumination to the front and rear of a user. The stirrup provides a means for a user to nestle their foot to provide proper support.

1 Claim, 3 Drawing Sheets

CANE WITH A LEG STRAP

BACKGROUND OF THE INVENTION

1. Field of the Invention

The present invention relates to a cane system and, more particularly, to a cane system that includes an integral light embedded in the handle in addition to multiple leg attachment straps to aid a user with a mobility disability.

2. Description of the Related Art

Several designs for a cane have been designed in the past. None of them, however, include a cane having an integral light in the handle, a leg attachment strap, and a foot attaching stirrup. The cane includes a rod assembly and a stirrup assembly. In one embodiment, the rod assembly includes a rod being a uniform cylindrical structure that is adapted to extend the length of a user's leg. The handle is disposed at a topmost end of the rod and includes the light being embedded therein to provide illumination to the front and rear of a user. The stirrup provides a means for a user to nestle their foot to provide proper support. It is known that users with a mobility disability often need aid to walk. Traditional canes provide limited proper support, and therefore there is a need for an improved cane system.

Applicant believes that a related reference corresponds to U.S. Pat. No. 4,883,587 issued for an auxiliary cane or crutch device for helping to lift legs or feet or foot. Applicant believes that another related reference corresponds to U.S. Pat. No. 10,034,522 issued for a cane having a handle with a flashlight. However, the cited references differ from the present invention because they fail to disclose the cane with a foot attaching stirrup with the leg attachment strap.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a cane system with a leg strap that provides a user with ability to see in the dark and be aware of their surroundings.

It is another object of this invention to provide a cane system with a leg strap that includes a footrest stirrup with rubber coating to allow a user to easily grip the footrest with their foot and prevent slipping.

It is still another object of the present invention to provide a cane system with a leg strap that aids in supporting the weight of a patient while allowing the leg to be lifted when needed.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
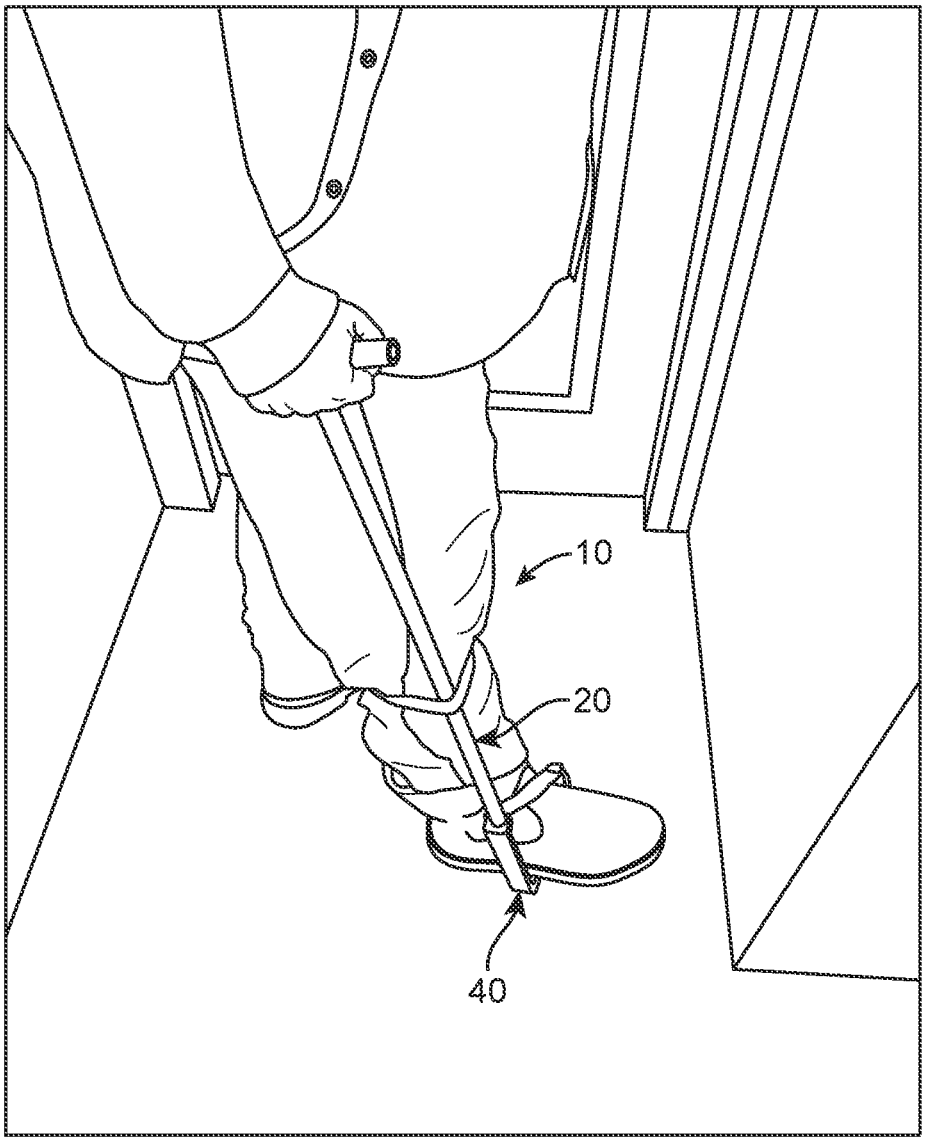
FIG. 1 represents an operational isometric view of a cane system 10 in accordance with an embodiment of the present invention.

Referring now to the drawings, where the present invention is generally referred to with numeral 10, it can be observed a cane system 10 which basically includes a rod assembly 20 and a stirrup assembly 40.

Figure 2:
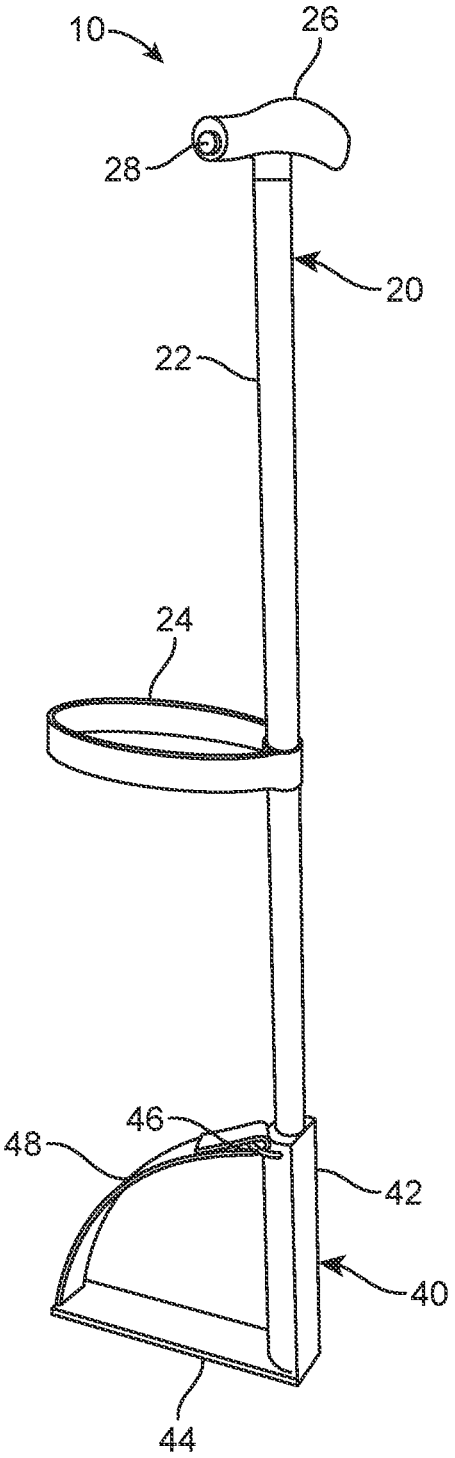
FIG. 2 shows an isometric view of cane system 10 depicting rod assembly 20 and stirrup assembly 40 in accordance with an embodiment of the present invention.
Figure 3:
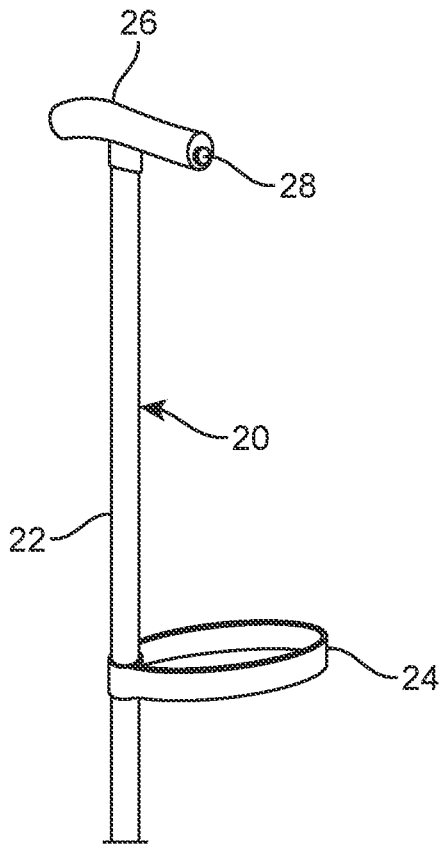
FIG. 3 illustrates an enlarged view of rod assembly 20 in accordance with an embodiment of the present invention.

Rod assembly 20 can be effectively observed in FIG. 2 of the provided drawings. Rod assembly 20 includes a rod 22 which may be provided as a uniform cylindrical member that extends the length of a user's leg. In the present embodiment, rod 22 may be made of a metal, or reinforced plastic material. It should be understood that rod 22 may be made of any suitable material. Additionally, rod 22 further includes a top most end and a bottom most end. Rod assembly 20 further includes an attachment strap that is positioned entirely between the top most end and the bottom most end of the rod 22. In the present embodiment, attachment strap 24 may be provided as an extended hook and loop fastening member with a suitable length to wrap around a user's leg. FIG. 1 depicts rod assembly 20 in an operative setting. It can be observed that attachment strap 24 is wrapped around a user's leg, preferably beneath the knee of the user. This configuration can be implemented to aid a user with a knee disability. Attachment strap 24 may also be provided as a cloth strap that implements other forms of fastening members such as push members, adhesives, buckles and the like.

Rod assembly 20 further includes a handle 26 positioned on the top most end of the rod 22. In the present embodiment, handle 26 may be made of the same material as rod 22. However, other embodiments may feature handle 26 being made of varying materials. Handle 26 may be implemented as a cylindrical member that is orthogonally positioned with respect to the top most end of rod 22. Other embodiments may feature handle 26 positioned in other configurations. Embedded within handle 26 is a light member 28. In the present embodiment, light member 28 may be provided as an LED or fluorescent light that generates light to aid in improving the visibility of a user. Handle 26 may include a front and a rear end. IN the present embodiment, light member 28 protrudes outwardly from the front and rear end and is visible therefrom. As a result, the light member 28 is illuminating in the direction of which the user is supporting themselves with respect to the rod assembly 20. Light member 28 may be selectively actuated by means of a button located on the handle. In other embodiments light member 28 is a motion sensing light member that is actuated upon the detection of a user operating the rod assembly 20.

Figure 4:
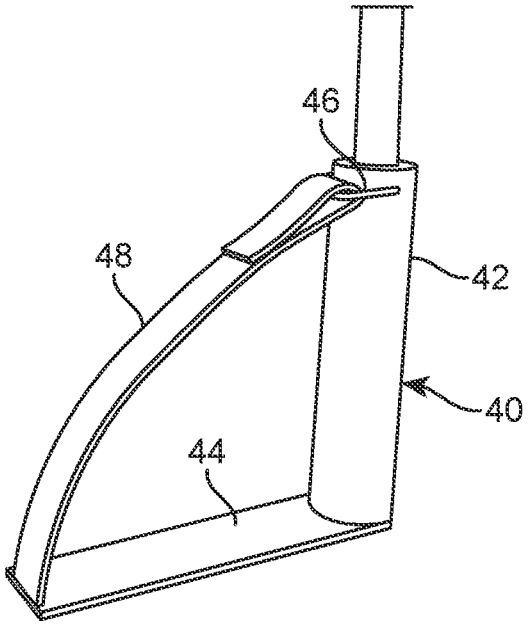
FIG. 4 is a representation of an enlarged view of stirrup assembly 40 in accordance with an embodiment of the present invention.

Stirrup assembly 40 includes a first portion 42 and second portion 44 as observed in FIG. 4 of the provided drawings. In one embodiment, first portion 42 and second portion 42 are provide as rectangular structural members that are positioned orthogonally with respect to each other to form a right-angle base. In the present embodiment, first portion 42 is operatively coupled to the bottom most end of rod 22. This operatively coupling could be achieved through means of welding or fastening members. Additionally, second portion 44 includes a rubber support layer with is adapted to provide a high coefficient of friction. As a result, a user may comfortably secure their foot within the stirrup without worrying of their foot slipping out of the stirrup.

Stirrup assembly 40 further includes a stirrup strap 48 that is attached to the first portion 42 and second portion 44 through means of a loop members 46. In the present embodiment, a loop member 46 is positioned on a top end of the first portion 42 and positioned on a distal end of the second portion 44. Loop members 46 are provided as closed structural ring members. Stirrup strap 48 is then mounted to the portions such that it extends from the first portion 42 to the second portion 44 to form a right triangle. During operation, a user may position their foot within the stirrup assembly 40 and then secure the stirrup strap 48 to ensure that their foot does not slip from the stirrup. The user may then use the attachment strap 24 to secure rod 22 to their leg. Preferably, attachment strap is configured to be coupled to the leg beneath the knee of the user. The user may then utilize the cane to aid with mobility. Additionally, the user may selectively actuate the light member 28 in order to provide needed visibility in dark areas.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A system for a cane, consisting of:

a) a rod assembly including a rod with a top most end and a bottom most end, wherein said rod assembly includes an attachment strap positioned entirely between the top most end and the bottom most end, wherein said rod assembly further includes a handle positioned on the top most end of the rod, wherein said handle is orthogonally mounted to the top most end of the rod, said handle having a light embedded therein which is visible from a front end and rear end of the handle, wherein said light is one of either an LED light or a motion sensing light; and b) a stirrup assembly including a first portion and a second portion being orthogonally positioned with respect to each other, wherein a top end of the first portion is operatively engaged with the bottom most end of the rod, wherein said first portion includes a first loop member positioned at the top end, wherein said second portion includes a second loop member positioned on a distal end thereof, wherein said stirrup assembly further includes a stirrup strap extending across the first portion and the second portion, wherein said stirrup strap includes a rubber support layer located on the interior section of the second portion, wherein the first portion, the second portion, and the third portion form a triangular shape when joined together.

* * * * *